US006224035B1

(12) United States Patent
Parkhe et al.

(10) Patent No.: US 6,224,035 B1
(45) **Date of Patent: *May 1, 2001**

(54) STAPLE REMOVING DEVICE

(76) Inventors: Vijay D. Parkhe, 655 S. Fair Oaks Ave., #D108, Sunnyvale, CA (US) 94806; Dttatraya P. Parkhe, 6 Alankar Hous. Society, Near Ashirwad Bus Stop, Maharashtra (IN), 422101

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/949,743

(22) Filed: Oct. 14, 1997

(51) Int. Cl.[7] ..... B25C 11/00
(52) U.S. Cl. ..... 254/28
(58) Field of Search ..... 294/92; 254/28, 254/25

(56) References Cited

U.S. PATENT DOCUMENTS 957,124 * 2/1999 Young ..... 254/28
1,430,497 * 9/1922 Engberg ..... 254/25
3,310,288 * 3/1967 Berry ..... 254/28
4,219,187 * 8/1980 Brumfield ..... 254/28
4,691,427 * 9/1987 Hill ..... 254/28
5,865,425 * 2/1999 Meadows ..... 254/131

* cited by examiner

*Primary Examiner*—David A. Scherbel
*Assistant Examiner*—Lee Wilson
(74) *Attorney, Agent, or Firm*—Larry B. Guernsey; Hickman Stephens Coleman & Hughes, LLP

(57) ABSTRACT

A simple and novel device to remove staple from sheet binding stack of papers comprising of a thin blade having two serrated notches formed by inner 1 and outer members 9 and 10 has been designed. A thin inner blade member is adopted to go beneath the bridge 3 of the staple, lift the legs 7 and 8 of staple out of paper and exposing them for firmly grasping in the two notches 5 and 6 during removal of the staple. The predetermined notches and cross sectional shapes of inner and outer members help to grasp and entangle the leg of the staple and does not allow it to slip and break during removal. The grip provided by the notch and in combination with leverage provided by the inner member by lifting one side of the leg of the staple at a time results in less pin breakage, less slippage and easy removal.

16 Claims, 3 Drawing Sheets

STAPLE REMOVING DEVICE

BACKGROUND OF THE INVENTION

This invention relates to a device for removing staples or similar fasteners from paper, drawing boards and the like material. The existing devices mutilated the paper during staple removal or break the pin because of the pulling action. In absence of positive grip available in conventional staple removers sometimes only one leg is pulled out of the paper stack. It is also observed that certain staple removers are useful for only certain type or size of the staples and are not universal in application. The present invention is an improved staple removal device that more securely grasps the legs and there by bridge of the staple firmly to remove it from paper it holds without breaking the pin or part remaining in the paper or tearing or mutilating the paper. An another object of this invention is to provide a device having these advantages and capacities and which is extremely simple and durable in its construction, readily and easily operated and comparatively inexpensive to manufacture.

SUMMARY OF THE INVENTION

This invention consists of staple removing device for removing various sizes of staples secured to plurality of sheets of paper or associated material. This modified device has a notch formed by inner and outer members to assist in staple removal process. Taper shaped inner member is adapted to go beneath the bridge of the staple to lift the legs for holding and the staple legs are sandwiched between two said members. This grip provided by the notch and in combination with the leverage and force provided by the inner member from underneath the bridge removes the staple by lifting the device on its side one at a time. In addition outer members are pivoted on inner member to hold the legs of staple like a plier. Serrations provided on the notch prevent staple legs from slipping while removal. Thus the improvement made in the device do not allow the staple to break or to remain in the stack of paper and mutilate the paper. Device having these advantages and capacities and which is extremely simple and durable in its construction, readily and easily operated and comparatively inexpensive to manufacture. The conventional staplers can adopt this device for ready use because of its simple construction.

These and other objects and advantages of the present invention will be fully apparent from the following description when taken in connection with the annexed drawings:

DETAILED DESCRIPTION OF PREFERRED EMBODIMENT

A. First Preferred Embodiment

Figure 1:
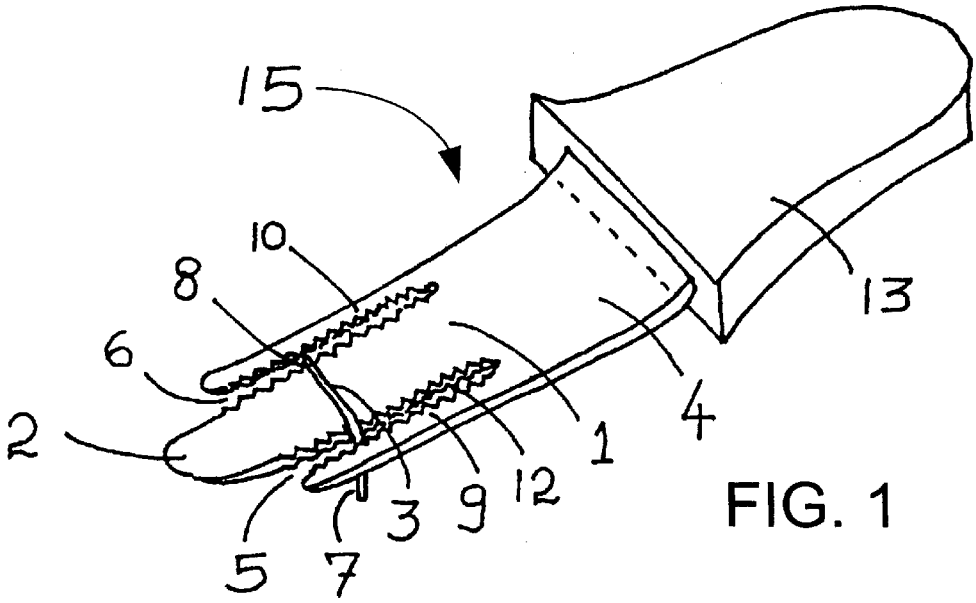
FIG. 1 is an isometric view of the staple removing device showing inner member underneath the bridge of the staple as at the beginning of a staple removal operation.

Illustrated in FIG. 1 is a staple removing device 15 which is one of the preferred embodiment of the present invention, showing a thin inner blade member 1 of device 15 may be of metal or like hard material having a taper and rounded front end 2 which is adapted to go beneath the bridge 3 of the staple and paper stack which it holds. There are two notches 5 and 6 made on inner member 1 resulting in two outer members 9 and 10. The width of the notches 5 and 6 is just enough to snugly fit the thickness of the legs 7 and 8 of staple. The surfaces of notches 5 and 6 have serrations 11 and 12 respectively. The predetermined cross sectional configuration of inner member 1 and outer members 9 and 10 is such that the notches 5 and 6 firmly grasps the legs 7 and 8 of the staple during removal. The bridge 3 of the staple is shown above the inner member 1 in a position to be removed. Notches 5 and 6 made in this device do not allow the legs 7 and 8 of the staple to break nor allow to remain inside the paper stack while removing the staple. This prevents any paper mutilation during removal. The device 15 has a handle 13 fixed on rear end 4 of inner blade to give a good grip. The removal of staple can be achieved by following process 1]Lift the device 15 up on each side to remove the legs 7 and 8 of the staple at a time 2] move the complete device 15 up by using handle 13 and taking the front end of inner member 1 as a fulcrum 3] Roll the device on its sides by rotating handle 13 through 180 degrees. While removing the staple the grip available by means of notches 5 and 6 on the legs 7 and 8 in combination with the leverage and force available by inner member 1 on the bridge 3 and the legs 7 and 8 of the staple are removed with minimum force. The limited gap available in notches 5 and 6 entangles the bent legs 7 and 8 removed from the paper and prevents slipping, straightening or breaking of the staple.

B. Second Preferred Embodiment

Figure 2:
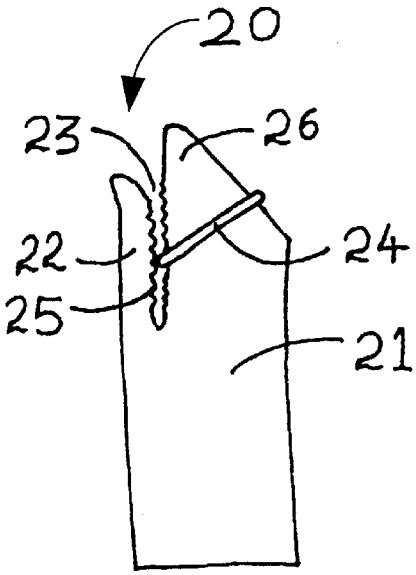
FIG. 2 is a plan view of another version of the staple removal device.

FIG. 2 is a second preferred embodiment of the present invention of a staple remover wherein the device 20 is identical in structure and function as explained in FIG. 1 except as described bellow. In this version the inner member 21, has a taper shape 26 on front end to accommodate various lengths of the staple 24. Inner member 21 and outer member 22 make a notch 23 having serrations 25 The Staple 24 is in the position of removal.

C. Third Preferred Embodiment

Figure 3:
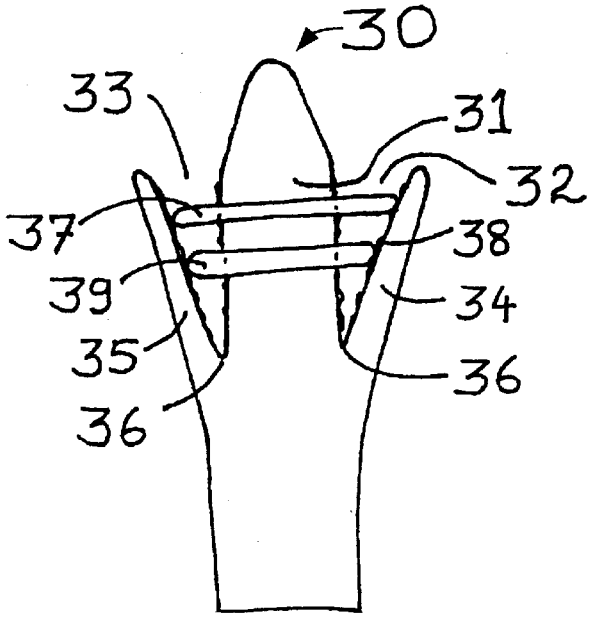
FIG. 3 is another version of this device in plan view showing wedge formation.

Illustrated in FIG. 3 is third preferred embodiment of the present invention wherein the device 30 has two notches 32 and 33 having serrations 38 on the inner member 31 and two outer members 34 and 35. The outer members 34 and 35 are at an angle to the inner member 31 and all said members are in the same plane. The said notches 32 and 33 have a triangular shaped notch with wide opening in the front and narrow at the rear points 36. These triangular notches 32 and 33 hold the staple 37 and 39 firmly in the wedge during removal. Also notches 32 and 33 allow removal of staples 37 and 39 with various lengths and thickness as illustrated. Staple 39 is thicker and longer than staple 37.

D. Forth Preferred Embodiment

Figure 4:
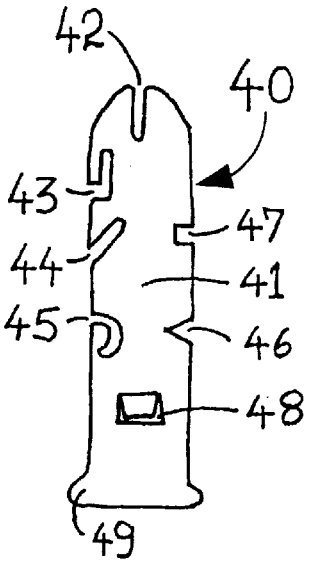
FIG. 4 is another version of the invention in the plan view showing various types of notches.

In a fourth preferred embodiment of staple removing device 40 illustrated in FIG. 4, include a thin blade member 41 adopted to enter bellow the bridge of the staple comprising various predetermined cross sectional notches 42, 43, 44, 45, 46 and 47 to grasp the leg of the staple for removal. Notch 48 is made by taking a U shape cut facing rear end 49 and lifting the cut member up forming triangular notch facing rear side to hold the bridge of the staple during removal. The said inner member has a handle 49 at the rear end.

E. Fifth Preferred Embodiment

Figure 5:
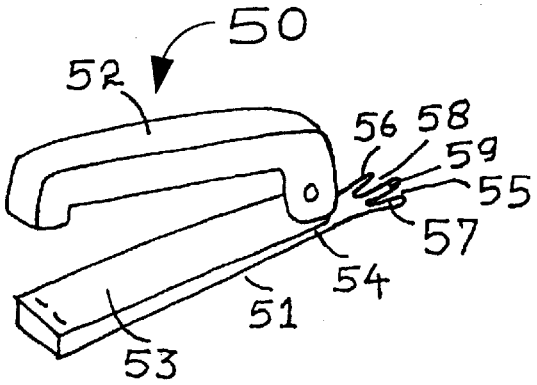
FIG. 5 is another version of the invention in isometric view, as an integral part of the staple fixing device.

In a fifth preferred embodiment of the staple removing device 50 as illustrated in FIG. 5 is the staple fixing gadget 51 comprising of upper member 52 and lower member 53 said lower member 53 is adopted for removing staples at its rear end 54 As per present invention an inner member 59 and outer members 56 and 57 form notches 55 and 58.

F. Sixth Preferred Embodiment

Figure 6:
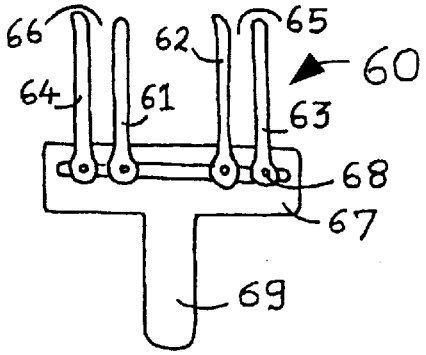
FIG. 6 is another version of the invention in the plan view.

In a sixth preferred embodiment a staple removing device 60 as illustrated in FIG. 6 have two inner members 61 and 62 and outer members 63 and 64 mounted on a common frame 67 having a handle 69 to form notches 65 and 66, said inner and outer members 61, 62, 63, and 64 are provided to form predetermined and various cross sectional notches 65 and 66 by adjusting and locking them on the said common frame 67 by screws 68 and said device is used for removing the staple of various sizes and shapes.

G. Seventh Preferred Embodiment

Figure 7:
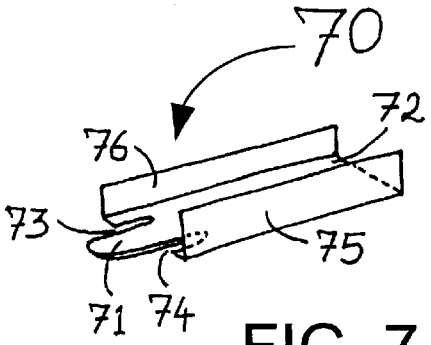
FIG. 7 is another version of this invention in the form of an U shape channel.

In seventh preferred embodiment, a staple removing device 70 is made from a "U" shape channel as illustrated in FIG. 7. It has an inner member 71 of round shape in front side made from a base of "U" shape channel 72 with two notches 73 and 74 made on both sides of the inner member 71 with two adjacent outer members 75 and 76 comprising the two walls of the channel 72. The notches 73 and 74 along with the wall type outer members 75 and 76 grasp the legs of the staple for effective removal.

H. Eighth Preferred Embodiment

Figure 8:
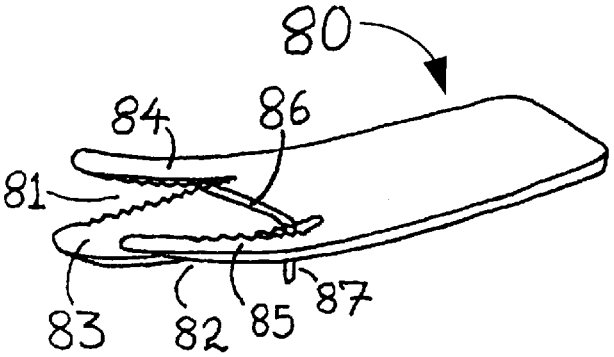
FIG. 8 is another version of the invention in an isometric view.
Figure 8A:
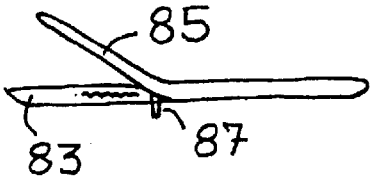
FIG. 8A is a side view of the device shown in FIG. 8 showing staple leg embedded in the vertical wedge of the device.

In an eighth preferred embodiment, a staple removing device 80 as illustrated in FIG. 8 wherein two triangular notches 81 and 82 are formed in vertical plane between inner member 83 and lifted outer members 84 and 85. The inner member 83 is inserted beneath the bridge of the staple 86. In this device staple leg 87 is sandwiched between inner member 84 and outer member 85 during removal. FIG. 8A shows side elevation of the device showing inner member 83 and lifted outer member 85 forming the notch 82 holding staple leg 87.

I. Ninth Preferred Embodiment

Figure 9:
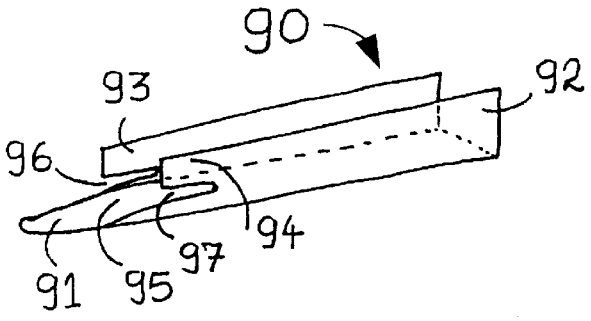
FIG. 9 is another version of the device in the form an U shape channel shown in an isometric view.

In ninth preferred embodiment, a staple removing device 90 as illustrated in FIG. 9 has an inner member 91 made from a base 95 of "U" shape channel 92 and is adapted to go beneath the bridge of the staple. The two walls of the channel are formed as outer members 93 and 94 which are at right angles to its base 95. These two notches 96 and 97 are provided on the walls of the both sides of the outer members 93 and 94 and on the front side and above the inner member 91. Outer members 93 and 94 do not allow staple legs to slip during removal. In this version the notches will grasp the portion of the angle between the bridge and the legs.

J. Tenth Preferred Embodiment

Figure 10:
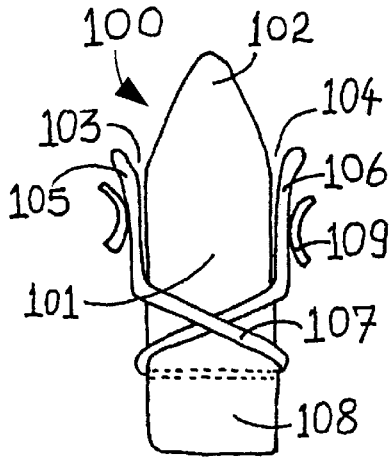
FIG. 10 is another version of the device in the plan view showing a separately made outside members mounted on the inner member.

In the tenth preferred embodiment of this invention a staple removing device 100 as illustrated in FIG. 10 has a blade 101 having a taper shaped inner member 102 on front side adapted to go beneath the bridge of the staple to lift the legs of the staple from the paper stack and having two notches 103 and 104 formed by outer members 105 and 106 the said outer members 105 and 106 are formed by mounting a clip 107 made from a single wire or a strip of metal by forming a round loop having two legs which form outer members 105 and 106 of the device, when mounted by inserting on the inner member 102. This clip like member 107 is held firmly on the blade 108 by spring action of the wire The said outer members 105 and 106 grasp the legs of the staple firmly because of the spring action. In addition a pair of ears 109 are provided on outer members 105 and 106 to hold the legs of staple against the inner member 102 firmly by fingers during removal.

K. Eleventh Preferred Embodiment

Figure 11:
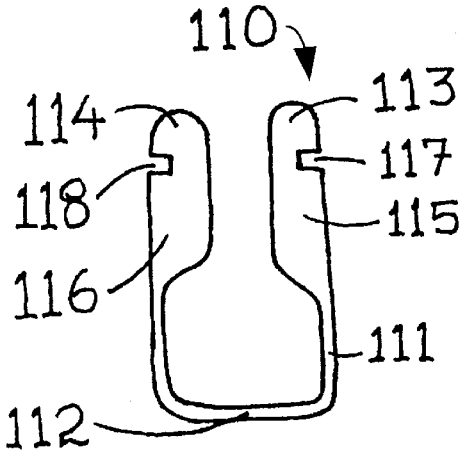
FIG. 11 is another version on the device in an isometric view.

The eleventh preferred embodiment of this invention a staple removing device 110 as illustrated in FIG. 11 is a strip 111 having a bend in the center 112 to form two flat ends 115 and 116 having spring action and rounded at the front side and termed as inner members 113 and 114 having two side notches 117 and 118 these two inner members are adapted to enter beneath the bridge of the staple there by legs of the staple are firmly engaged in the notches 117 and 118 and because of the firm grasping and spring action of said inner members the staple is removed easily by lifting up each side of the device one at a time.

L. Twelfth Preferred Embodiment

Figure 12:
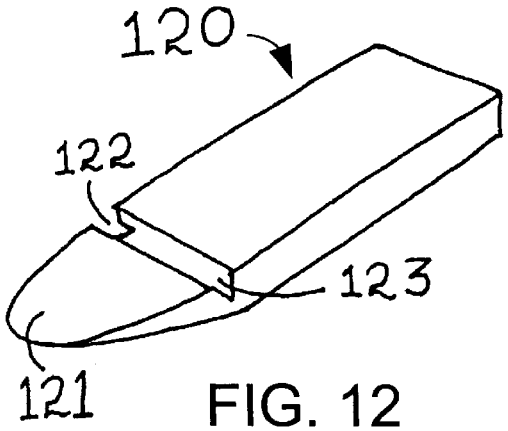
FIG. 12 is an another version of the device in an isometric view of an inner member illustrating a notch and a slot.

In twelfth preferred embodiment of this invention a device 120 illustrated in FIG. 12 has an inner member 121 comprising of a notch 122 and a slot 123 to grasp leg and bridge of the staple during removal. The slot 123 is meant for holding bridge of the staple from sides and not from top.

Figure 13A:
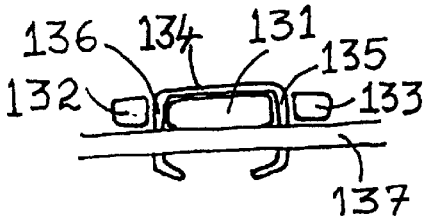
FIG. 13A is a front view of this device during removal of staple.

FIG. 13A is a front view showing inner member 131 outer members 132, 133 as at the beginning of the staple removal process. The inner member 131 is shown underneath the bridge of the staple 134 and above the paper stack 137. The legs 135, 136 of the staple are sandwiched between inner member 131 and outer members 132 and 133.

Figure 13B:
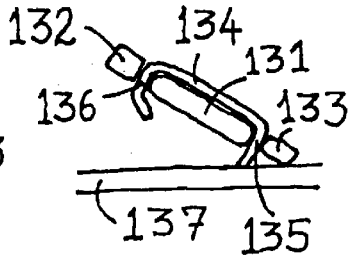
FIG. 13B is a front view when one of the legs of the staple is removed by lifting one side of the device.

FIG. 13B is a front view showing staple leg 136 removed from the paper stack 137 by lifting the device on one side and said leg 136 entangled between inner member 131 and outer member 132. As shown in the FIG. 13B only one leg of the staple is removed at a time requiring less force for removal compared to removal of both legs simultaneously. In addition less force is required because of leverage obtained by the force applied on one side and fulcrum taken at the other end.

Figure 13C:
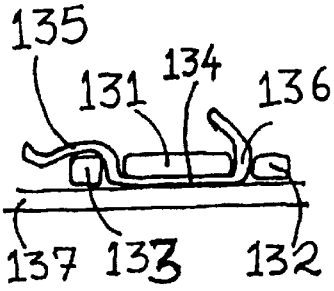
FIG. 13C is a front view when both the legs of the staple are removed by rotating the device through 180 degrees on its sides showing the entangle legs.

FIG. 13C is a front view showing both legs 135, 136 of the staple removed from paper stack 137 after 180 degrees rotation of the device.

While only a preferred form of the invention is shown and described it is understood that other forms of this invention are contemplated and numerous size and shapes changes and modifications and arrangements may be made therein without departing the spirit of the invention as setforth in the appended claims.

We claim:

1. A device for removing staples which bind a stack of sheets, said staples having a bridge and first and second side legs, said device comprising:

a blade adapted to enter between the bridge of the staple and the stack of sheets, said blade having at least one inner member and two outer members, said inner and outer members surrounding two notches;

a handle portion connected to said blade; and each of said two notches being configured to accept entry of one of said staple side legs, such that said side leg is gripped between said at least one inner member and one of said outer members, such that when leveraging force is applied to said device to remove said staple, said side legs of said staple are captured and supported from breaking and a substantial portion of said leveraging force is applied directly to said side legs.

2. A device according to claim 1 wherein:

said inner and outer members include inner surfaces forming boundaries of said notches, said inner surfaces including serrations to improve the grip on said legs of said staple for removal.

3. A device according to claim 1 wherein:

said at least one inner member has a front end, said front end having a taper profile shape to accommodate broader staple bridges.

4. A device according to claim 1 wherein:

said at least one inner member further includes a plurality of predetermined notches.

5. A device according to claim 1 wherein:

said device for removing staples is attached to a stapler.

6. A device according to claim 1 wherein:

said outer members include front ends which are placed at an angle from said at least one inner member in the same horizontal plane forming a wedge to grasp firmly the staple legs.

7. A device according to claim 1 wherein:

said outer members include front ends which are placed at an angle from said at least one inner member in the same vertical plane forming a wedge to grasp firmly the staple legs.

8. A device according to claim 1 wherein:

said outer members are formed by attaching at least one separate member onto said at least one inner member.

9. A device according to claim 1 wherein:

said outer members form a loop having two legs which are spring biased to hold said legs of said staple for removal.

10. A device according to claim 1 wherein:

said at least one inner member and said outer members form a U-shaped channel.

11. A device according to claim 1 wherein:

said outer members each have an ear to facilitate grasping of said staple.

12. A device as in claim 1, wherein:

said outer members and said central member are substantially co-planar.

13. A method of removing standard staples which bind a stack of sheets, said staples each having a bridge and first and second side legs, comprising the steps of:

(A) providing a device including a blade having at least one inner member and two outer members, said inner and outer members surrounding two notches, each of said two notches being configured to accept entry of one of said staple side legs;

(B) inserting said inner member between the bridge of the staple and the stack of sheets such that said side leg is gripped between said at least one inner member and one of said outer members; and (C) levering said device so that levering force is applied to said staple, a substantial portion of said leveraging force being applied directly to said gripped side legs.

14. The method of claim 13, wherein:

said outer members and said central member of said blade are substantially co-planar.

15. A device for removing standard staples which bind a stack of sheets, said staples having a bridge and first and second legs, said device comprising:

a blade having an elongated central member having a tapered front end for insertion between said bridge of the staple and a stack of sheets;

two outer members spaced from said central member so that each of the side legs of said staple may enter between one of said outer members and said central member as said blade is inserted; and said central member being of appropriate width so that both of said legs are captured and gripped between said outer members and said central member as insertion is completed, and so that when leveraging force is applied to said device to remove said staple, a substantial portion of said leveraging force is applied directly to said captured side legs.

16. A device as in claim 15, wherein:

said outer members and said central member of said blade are substantially co-planar.

* * * * *